US011698212B2

(12) United States Patent
Cho et al.

(10) Patent No.: US 11,698,212 B2
(45) Date of Patent: Jul. 11, 2023

(54) AIR CONDITIONER

(71) Applicant: LG ELECTRONICS INC., Seoul (KR)

(72) Inventors: Eunjun Cho, Seoul (KR); Jungmin Park, Seoul (KR); Pilhyun Yoon, Seoul (KR); Seongho Hong, Seoul (KR); Yejin Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 61 days.

(21) Appl. No.: 17/370,114

(22) Filed: Jul. 8, 2021

(65) Prior Publication Data

US 2022/0011029 A1 Jan. 13, 2022

(30) Foreign Application Priority Data

Jul. 13, 2020 (KR) ..... 10-2020-0085992

(51) Int. Cl.
*F25B 43/04* (2006.01)
*F25B 41/31* (2021.01)
(Continued)

(52) U.S. Cl.
CPC ..... *F25B 43/043* (2013.01); *F25B 13/00* (2013.01); *F25B 39/00* (2013.01); *F25B 41/31* (2021.01);
(Continued)

(58) Field of Classification Search
CPC ..... F25B 43/043; F25B 41/31; F25B 13/00; F25B 39/00; F25B 2400/0403; F25B 2400/0409; F25B 2400/23
(Continued)

(56) References Cited

U.S. PATENT DOCUMENTS

2005/0279128 A1 12/2005 Otake et al.
2019/0242622 A1* 8/2019 Matsuda ..... F25B 1/04

FOREIGN PATENT DOCUMENTS

CN 201731698 2/2011
CN 104613697 5/2015
(Continued)

OTHER PUBLICATIONS

Pdf file is translation of foreign reference JPH06241592A (Year: 1994).*

(Continued)

*Primary Examiner* — Henry T Crenshaw
*Assistant Examiner* — Kamran Tavakoldavani
(74) *Attorney, Agent, or Firm* — KED & Associates

(57) ABSTRACT

An air conditioner may include a compressor that compresses refrigerant; a condenser that condenses the refrigerant; at least one expansion valve that expands the refrigerant; a gas-liquid separator that separates and discharges the refrigerant into gas refrigerant and liquid refrigerant; an evaporator that evaporates the liquid refrigerant discharged from the gas-liquid separator; a refrigerant inflow pipe that connects the expansion valve and the gas-liquid separator; a bypass pipe that connects the gas-liquid separator and the compressor; and a refrigerant discharge pipe that connects the gas-liquid separator and the evaporator. The gas-liquid separator may include a housing in which a portion of the refrigerant inflow pipe, the bypass pipe, and the refrigerant discharge pipe may be disposed, and first and second partition walls disposed in the housing.

18 Claims, 10 Drawing Sheets

(51) Int. Cl.
*F25B 13/00* (2006.01)
*F25B 39/00* (2006.01)

(52) U.S. Cl.
CPC ..... *F25B 2400/0403* (2013.01); *F25B 2400/0409* (2013.01); *F25B 2400/23* (2013.01)

(58) Field of Classification Search
USPC ..... 62/85
See application file for complete search history.

(56) References Cited

FOREIGN PATENT DOCUMENTS

| | | | | |
|---|---|---|---|---|
| CN | 105135738 | | 12/2015 | |
| JP | 06-241592 | | 8/1994 | |
| JP | 06241592 A | * | 8/1994 | ..... F25B 2400/13 |
| JP | JP 10-111047 | | 4/1998 | |
| JP | 2007-139250 | | 6/2007 | |
| JP | 2008-256305 | | 10/2008 | |

OTHER PUBLICATIONS

Pdf is translation of foreign reference JP 06241592 A (Year: 1994).*
European Search Report issued in Application No. 21184552.4 dated Nov. 23, 2021.
Chinese Office Action dated Oct. 31, 2022 issued in CN Application No. 202110702805.0.

* cited by examiner

AIR CONDITIONER

CROSS-REFERENCE TO RELATED APPLICATION(S)

This application claims the priority benefit of Korean Patent Application No. 10-2020-0085992, filed in Korea on Jul. 13, 2020, the disclosure of which is incorporated herein by reference in its entirety.

BACKGROUND

1. Field

An air conditioner is disclosed herein.

2. Background

In general, an air conditioner refers to an apparatus that cools and heats a room through compression, condensation, expansion, and evaporation processes of refrigerant. If an outdoor heat exchanger of the air conditioner serves as a condenser, whereas an indoor heat exchanger serves as an evaporator, the room may be cooled. On the other hand, if the outdoor heat exchanger of the air conditioner serves as an evaporator, whereas the indoor heat exchanger serves as a condenser, the room may be heated.

A conventional air conditioner includes a gas-liquid separator that receives a refrigerant that has passed through an expansion valve and separates and discharges the received refrigerant into gas refrigerant and liquid refrigerant. In this case, the gas refrigerant separated in the gas-liquid separator is injected into a compressor, and the liquid refrigerant separated in the gas-liquid separator may be supplied to an evaporator.

However, if the gas refrigerant and the liquid refrigerant are not sufficiently separated in the gas-liquid separator, there is a problem in that the liquid refrigerant is injected into the compressor, causing damage to the compressor. Recently, a lot of research has been conducted on a method of increasing a separation rate of gas refrigerant and liquid refrigerant in a gas-liquid separator.

BRIEF DESCRIPTION OF THE DRAWINGS

Embodiments will be described in detail with reference to the following drawings in which like reference numerals refer to like elements, and wherein.

DETAILED DESCRIPTION

Description will now be given according to embodiments disclosed herein, with reference to the accompanying drawings. For the sake of brief description with reference to the drawings, the same or equivalent components may be denoted by the same reference numbers, and description thereof will not be repeated. In general, suffixes such as "module" and "unit" may be used to refer to elements or components. Use of such suffixes herein is merely intended to facilitate description of the specification, and the suffixes do not have any special meaning or function. In the present disclosure, that which is well known to one of ordinary skill in the relevant art has generally been omitted for the sake of brevity. The accompanying drawings are used to assist in easy understanding of various technical features and it should be understood that the embodiments presented herein are not limited by the accompanying drawings. As such, the embodiments should be construed to extend to any alterations, equivalents, and substitutes in addition to those which are particularly set out in the accompanying drawings.

It will be understood that although the terms first, second, etc. may be used herein to describe various elements, these elements should not be limited by these terms. These terms are only used to distinguish one element from another. It will be understood that when an element is referred to as being "connected with" another element, there may be intervening elements present. In contrast, it will be understood that when an element is referred to as being "directly connected with" another element, there are no intervening elements present. A singular representation may include a plural representation unless context clearly indicates otherwise. Terms such as "includes" or "has" used herein should be considered as indicating the presence of several components, functions, or steps, disclosed in the specification, and it is also understood that more or fewer components, functions, or steps may likewise be utilized.

Figure 1:
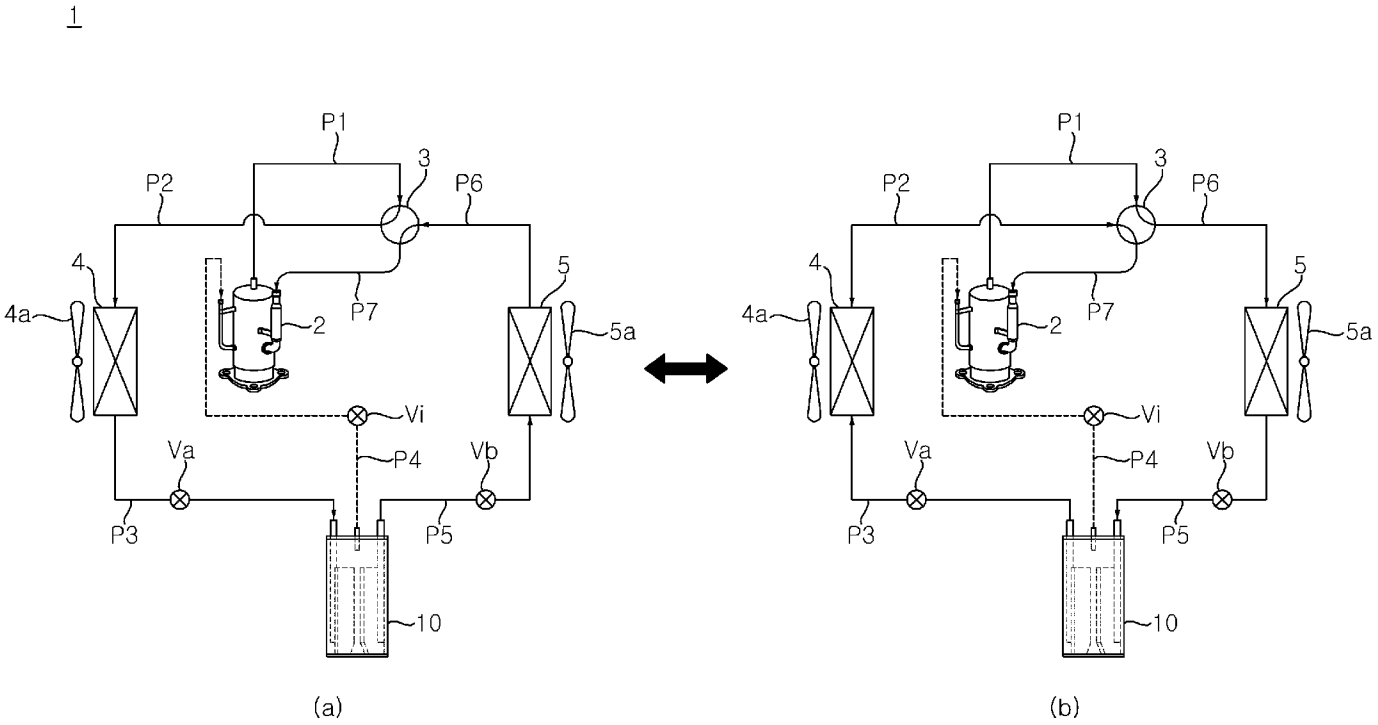
FIG. 1 is a schematic diagram of an air conditioner capable of performing a switching between a cooling operation and a heating operation according to an embodiment and shows a flow of a refrigerant, and explains an embodiment in which gas refrigerant discharged from a gas-liquid separator is injected to a medium pressure stage of a compressor.

Referring to FIG. 1, an air conditioner 1 may include a compressor 2, a switching valve 3, an outdoor heat exchanger 4, an indoor heat exchanger 5, expansion valves Va and Vb, and a gas-liquid separator 10. In addition, the air conditioner 1 may include an injection valve Vi.

The compressor 2 may compress refrigerant introduced from an accumulator (not shown) and discharge a high-temperature and high-pressure refrigerant. A first pipe P1 may be installed between the compressor 2 and the switching valve 3 to provide a flow path for refrigerant from the compressor 2 to the switching valve 3.

The switching valve 3 may receive a refrigerant which is discharged from the compressor 2 and passed through a first pipe P1. In addition, the switching valve 3 may guide the refrigerant introduced through the first pipe P1 to the outdoor heat exchanger 4 or the indoor heat exchanger 5, selectively. For example, the switching valve 3 may be a four-way valve. A seventh pipe P7 may be installed between the switching valve 3 and the compressor 2 to provide a flow path for refrigerant from the switching valve 3 to the compressor 2. In this case, the accumulator may be installed in the seventh pipe P7 to provide gas refrigerant to the compressor 2.

The outdoor heat exchanger 4 may heat-exchange the refrigerant and outdoor air. A direction of heat transfer between the refrigerant and outdoor air in the outdoor heat exchanger 4 may differ depending on an operation mode of the air conditioner, that is, depending on whether it is a cooling operation mode or a heating operation mode. An outdoor fan 4*a* may be disposed at one side of the outdoor heat exchanger 4 to adjust an amount of air provided to the outdoor heat exchanger 4. For example, the outdoor fan 4*a* may be driven by an electric motor. A second pipe P2 may be installed between the switching valve 3 and the outdoor heat exchanger 4 to provide a flow path for refrigerant connecting the switching valve 3 and the outdoor heat exchanger 4.

The indoor heat exchanger 5 may heat-exchange the refrigerant and heat transfer medium. A direction of heat transfer between the refrigerant and the heat transfer medium in the indoor heat exchanger 5 may differ depending on the operation mode of the air conditioner, that is, depending on whether it is a cooling operation mode or a heating operation mode. A sixth pipe P6 may be installed between the switching valve 3 and the indoor heat exchanger 5 to provide a flow path for refrigerant connecting the switching valve 3 and the indoor heat exchanger 5.

For example, the heat transfer medium may be indoor air, and heat exchange may be performed between the refrigerant and the indoor air in the indoor heat exchanger 5. In this case, an indoor fan 5*a* may be disposed at one side of the indoor heat exchanger 5 to adjust an amount of air provided to the indoor heat exchanger 5. For example, the indoor fan 5*a* may be driven by an electric motor.

For another example, the heat transfer medium may be water, and heat exchange may be performed between the refrigerant and water in the indoor heat exchanger 5. In this case, the water that has passed through the indoor heat exchanger 5 may be supplied to a radiator (not shown) installed indoors or a pipe installed in a floor to cool or heat an indoor space, or may be used to supply hot or cold water to a room by heating or cooling the water stored in a hot water tank. The indoor heat exchanger 5 may be a plate heat exchanger provided with a plurality of heat transfer plates stacked on each other. In this case, the refrigerant and water may flow through a flow path formed between a plurality of heat transfer plates, and may exchange heat with each other in a non-contact manner. When the heat transfer medium is water, the air conditioner may be referred to as an air-to-water heat pump (AWHP).

The first expansion valve Va and the second expansion valve Vb may be installed between the outdoor heat exchanger 4 and the indoor heat exchanger 5. More specifically, the first expansion valve Va may be installed in a third pipe P3 facing the second pipe P2, across the outdoor heat exchanger 4. In addition, the second expansion valve Vb may be installed in a fifth pipe P5 facing a sixth pipe P6, across the indoor heat exchanger 5. Depending on the operation mode of the air conditioner, the first expansion valve Va and the second expansion valve Vb may expand the refrigerant supplied from one of the outdoor heat exchanger 4 or the indoor heat exchanger 5 at a low temperature and low pressure.

The gas-liquid separator 10 may receive the expanded refrigerant from the first expansion valve Va or the second expansion valve Vb. A part or portion of the third pipe P3 and a part or portion of the fifth pipe P5 may be installed in the gas-liquid separator 10. In other words, the third pipe P3 may provide a flow path of refrigerant connecting the outdoor heat exchanger 4 and the gas-liquid separator 10, and the fifth pipe P5 may provide a flow path of refrigerant connecting the indoor heat exchanger 5 and the gas-liquid separator 10. The gas-liquid separator 10 may separate and discharge the refrigerant introduced through the third pipe P3 or the fifth pipe P5 into gas refrigerant and liquid refrigerant.

The fourth pipe P4 may provide a flow path for refrigerant connecting the gas-liquid separator 10 and a medium pressure stage of the compressor 2 described hereinafter. In this case, the injection valve Vi may be installed in a fourth pipe P4 to open and close the flow path of the fourth pipe P4.

Referring to (a) of FIG. 1, the compressor 2 may compress the refrigerant introduced from the accumulator and discharge the compressed refrigerant in a high temperature and high pressure state. The refrigerant discharged from the compressor 2 may flow into the outdoor heat exchanger 4 through the first pipe P1, the switching valve 3, and the second pipe P2, sequentially.

As heat energy is transferred from the refrigerant to the outdoor air in the outdoor heat exchanger 4, the refrigerant may be condensed. At this time, the outdoor heat exchanger 4 may serve as a condenser. The refrigerant which is condensed while passing through the outdoor heat exchanger 4 may pass through the first expansion valve Va in the third pipe P3 and may be expanded to a range corresponding to the medium pressure stage of the compressor 2. Here, the medium pressure stage of the compressor 2 may be understood as a pressure, that is, a low pressure, formed between the pressure of the refrigerant flowing into the compressor 2 and the pressure, that is, a high pressure, of the refrigerant discharged from the compressor 2. For example, the first expansion valve Va may be an electronic expansion valve (EEV) capable of adjusting an opening degree of the flow path of the third pipe P3. The refrigerant which is expanded while passing through the first expansion valve Va may flow into the gas-liquid separator 10 in a two-phase state.

The gas-liquid separator 10 may separate and discharge the two-phase refrigerant that flows in the gas-liquid separator 10 through the third pipe P3 into gas refrigerant and liquid refrigerant. The gas refrigerant separated by the gas-liquid separator 10 may flow into the medium pressure stage of the compressor 2 through the fourth pipe P4. In this case, the injection valve Vi may be a solenoid valve or an EEV that opens and closes the fourth pipe P4. The liquid refrigerant separated by the gas-liquid separator 10 may flow into the fifth pipe P5. The liquid refrigerant that flows in the fifth pipe P5 may pass through the second expansion valve Vb and expand to a range corresponding to a low pressure stage of the compressor 2. For example, the second expansion valve Vb may be an EEV. The refrigerant which is expanded while passing through the second expansion valve Vb may flow to the indoor heat exchanger 5 through the fifth pipe P5.

As the heat energy of the indoor air is transferred from the indoor heat exchanger 5 to the refrigerant, the refrigerant may be evaporated. At this time, the indoor heat exchanger 5 may serve as an evaporator. Further, according to the heat exchange between the refrigerant and the indoor air, a temperature of the indoor air is lowered, so that the indoor space may be cooled. The refrigerant which is evaporated while passing through the indoor heat exchanger 5 may flow into the compressor 2 through a sixth pipe P6, the switching valve 3, and a seventh pipe P7, sequentially, so that a refrigerant cycle for a cooling operation of the above-described air conditioner may be completed.

Referring to (b) of FIG. 1, the compressor 2 may compress the refrigerant introduced from the accumulator and discharge the compressed refrigerant in a high temperature and high pressure state. The refrigerant discharged from the compressor 2 may flow to the indoor heat exchanger 5 through the first pipe P1, the switching valve 3, and the sixth pipe P6, sequentially.

As heat energy is transferred from the refrigerant to the indoor air in the indoor heat exchanger 5, the refrigerant may be condensed. At this time, the indoor heat exchanger 5 may serve as a condenser. In addition, according to the heat exchange between the refrigerant and the indoor air, a temperature of the indoor air may be increased, so that the indoor space may be heated. The refrigerant which is condensed while passing through the indoor heat exchanger 5 may pass through the second expansion valve Vb in the fifth pipe P5 and may be expanded to a range corresponding to the medium pressure stage of the compressor 2. Here, the medium pressure stage of the compressor 2 may be understood as a pressure formed between the pressure, that is, the low pressure, of the refrigerant flowing into the compressor 2 and the pressure, that is, the high pressure, of the refrigerant discharged from the compressor 2. For example, the second expansion valve Vb may be an electronic expansion valve (EEV) capable of adjusting an opening degree of the flow path of the fifth pipe P5. The refrigerant expanded while passing through the second expansion valve Vb may flow to the gas-liquid separator 10 in a two-phase state.

The gas-liquid separator 10 may separate and discharge the two-phase refrigerants that flows into the gas-liquid separator 10 through the fifth pipe P5 into gas refrigerant and liquid refrigerant. The gas refrigerant separated in the gas-liquid separator 10 may flow into the medium pressure stage of the compressor 2 through the fourth pipe P4. In this case, the injection valve Vi may be a solenoid valve or an EEV that opens and closes the fourth pipe P4. The liquid refrigerant separated in the gas-liquid separator 10 may flow into the third pipe P3. The liquid refrigerant that flows into the third pipe P3 may pass through the first expansion valve Va and may expand to a range corresponding to the low pressure stage of the compressor 2. For example, the first expansion valve Va may be an EEV. The refrigerant which is expanded while passing through the first expansion valve Va may flow to the outdoor heat exchanger 4 through the third pipe P3.

As the heat energy of outdoor air is transferred from the outdoor heat exchanger 4 to the refrigerant, the refrigerant may be evaporated. At this time, the outdoor heat exchanger 4 may serve as an evaporator. The refrigerant which is evaporated while passing through the outdoor heat exchanger 4 may flow into the compressor 2 through the second pipe P2, the switching valve 3, and the seventh pipe P7, sequentially, so that a refrigerant cycle for the above-described heating operation of air conditioner may be completed.

Figure 2:
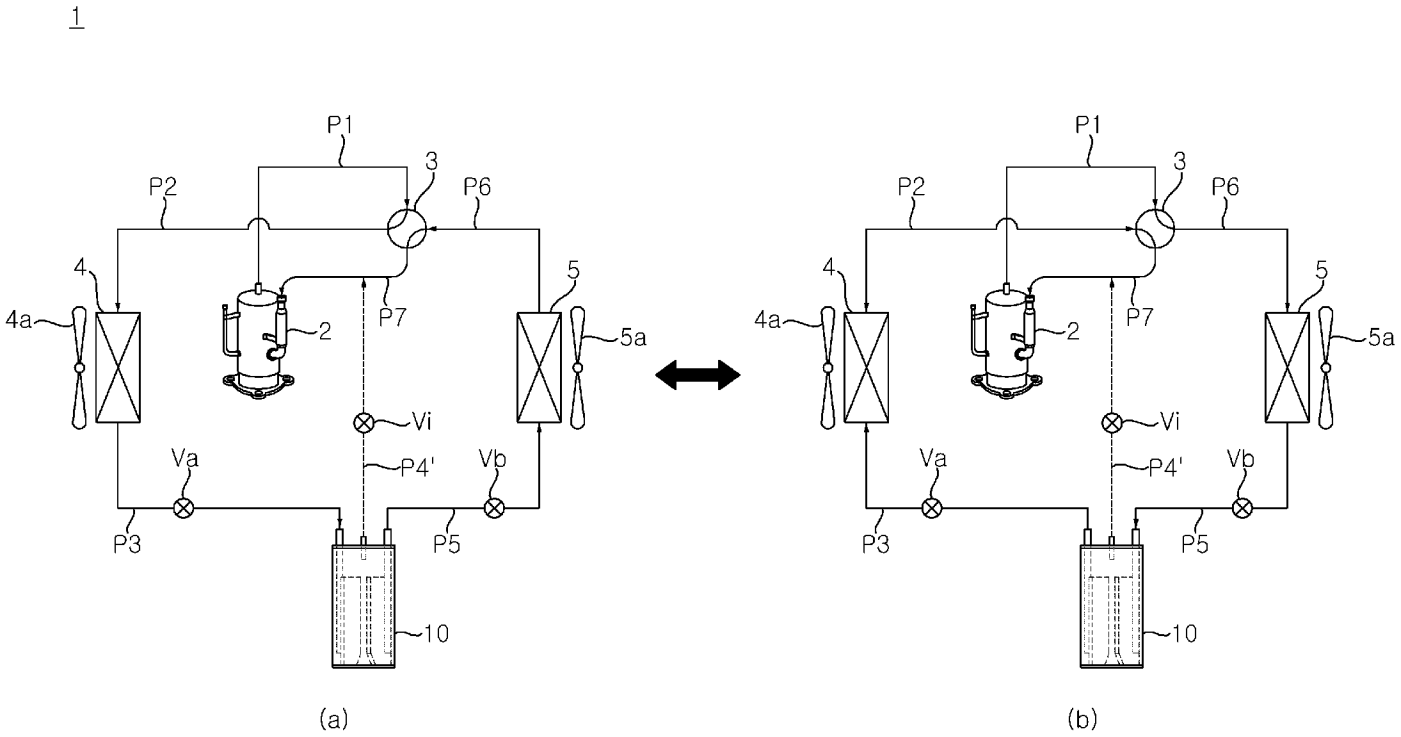
FIG. 2 is a schematic diagram of an air conditioner capable of performing a switching between a cooling operation and a heating operation according to an embodiment and shows a flow of a refrigerant, and explains an embodiment in which a gas refrigerant discharged from a gas-liquid separator is injected to a low pressure stage of a compressor.

Referring to FIG. 2, fourth pipe P4' may provide a flow path for refrigerant connecting the gas-liquid separator 10 and seventh pipe P7. In this case, the injection valve Vi may be installed in the fourth pipe P4' to open and close the flow path of the fourth pipe P4'. Accordingly, the gas refrigerant separated in the gas-liquid separator 10 may flow into the low pressure stage of the compressor 2 through the fourth pipe P4'.

Referring to (a) of FIG. 2, in the cooling operation mode of the air conditioner, the refrigerant which is condensed while passing through the outdoor heat exchanger 4 may be expanded to a range corresponding to the low pressure stage of the compressor 2 in the first expansion valve Va. In addition, the liquid refrigerant separated in the gas-liquid separator 10 may be provided to the indoor heat exchanger 5 through the fifth pipe P5, and the second expansion valve Vb may completely open the flow path of the fifth pipe P5. In addition, the gas refrigerant separated in the gas-liquid separator 10 may flow to the seventh pipe P7 through the fourth pipe P4' and may be provided to a suction end of the compressor 2.

Referring to (b) of FIG. 2, in the heating operation mode of the air conditioner, the refrigerant which is condensed while passing through the indoor heat exchanger 5 may be expanded to a range corresponding to the low pressure stage of the compressor 2 in the second expansion valve Vb. In addition, the liquid refrigerant separated in the gas-liquid separator 10 may be provided to the outdoor heat exchanger 4 through the third pipe P3, and the first expansion valve Va may completely open the flow path of third pipe P3. In addition, the gas refrigerant separated in the gas-liquid separator 10 may flow to the seventh pipe P7 through the fourth pipe P4' and may be provided to the suction end of the compressor 2.

Figure 3:
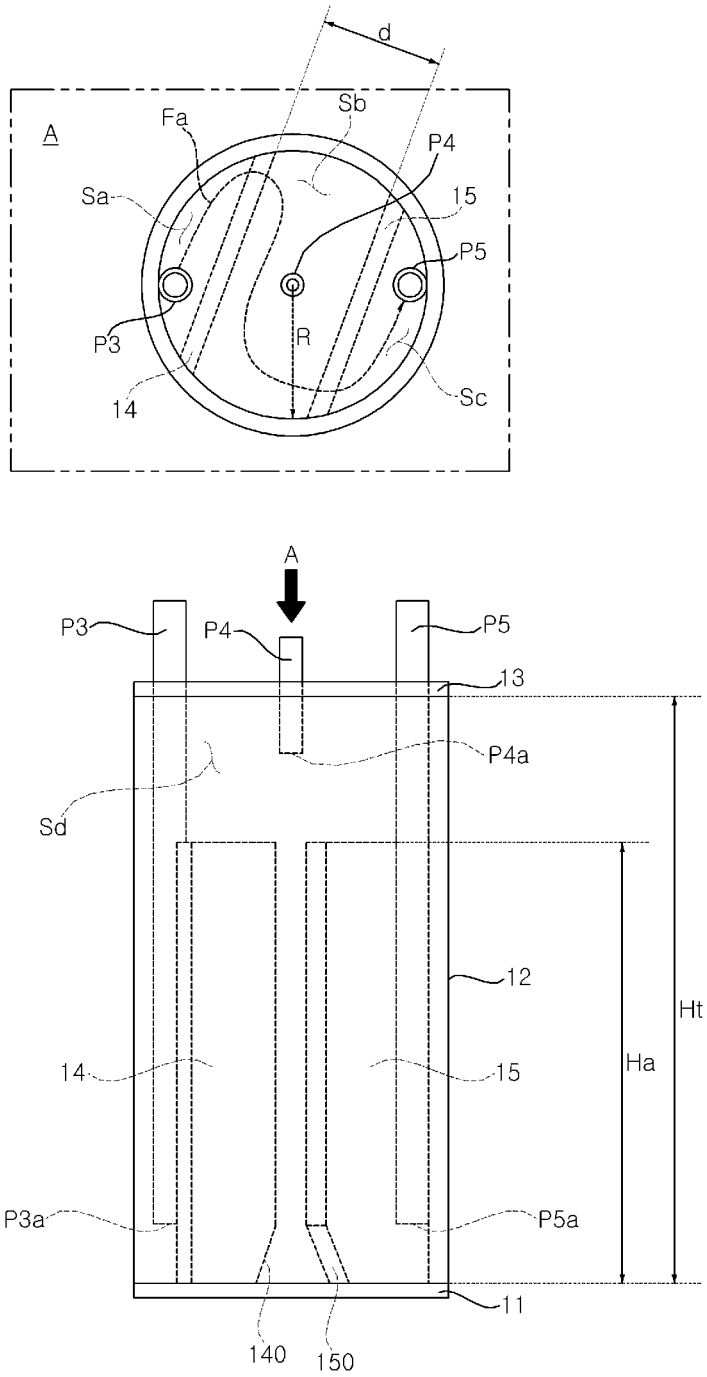
FIGS. 3 to 10 are diagrams of a gas-liquid separator of an air conditioner according to embodiments.

Referring to FIG. 3, the gas-liquid separator 10 may include a base 11, a housing 12, a cap 13, a first partition wall 14, and a second partition wall 15. According to this embodiment, the gas-liquid separator 10 may further include a third partition wall located between the first partition wall 14 and the second partition wall 15, in addition to the first partition wall 14 and the second partition wall 15 described hereinafter.

The base 11 may form a lower surface of the gas-liquid separator 10. The base 11 may be formed in a circular plate shape as a whole, and the housing 12, the first partition wall 14, and the second partition wall 15 may be installed thereon.

The housing 12 may form a side surface of the gas-liquid separator 10. The housing 12 may be formed in a cylindrical shape as a whole, and may accommodate the first partition wall 14 and the second partition wall 15 therein. A lower end of the housing 12 may be in close contact with the base 11 to prevent the refrigerant from leaking from an inside of the housing 12 to an outside.

The cap 13 may form an upper surface of the gas-liquid separator 10. The cap 13 may be formed in a circular plate shape as a whole, and a hole through which the third pipe P3, the fourth pipe P4, and the fifth pipe P5 may pass may be formed in the cap 13. An upper end of the housing 12 may be in close contact with the cap 13 to prevent the refrigerant from leaking from the inside of the housing 12 to the outside.

The first partition wall 14 and the second partition wall 15 may be installed in an internal accommodation space of the housing 12. The first partition wall 14 and the second partition wall 15 may be spaced apart from each other at a predetermined interval d. The lower end of the first partition wall 14 and the lower end of the second partition wall 15 may be fixed on the base 11. A side surface of the first partition wall 14 and a side surface of the second partition wall 15 may be fixed to an inner surface of the housing 12. An upper end of the first partition wall 14 and an upper end of the second partition wall 15 may be spaced apart from a lower surface of the cap 13.

Accordingly, the first partition wall 14 and the second partition wall 15 may divide the internal accommodation space of the housing 12 in a horizontal direction into a first space Sa, which is a space between the first partition wall 14 and the inner surface of the housing 12, a second space Sb, which is a space between the first partition wall 14 and the second partition wall 15, and a third space Sc, which is a space between the second partition wall 15 and the inner surface of the housing 12. In addition, a fourth space Sd may be formed between the lower surface of the cap 13 and the first and second partition walls 14 and 15.

The third pipe P3 may be vertically connected to an upper side of the gas-liquid separator 10 through a hole in the cap 13, and may be disposed in the internal accommodation space of the housing 12. The third pipe P3 may be disposed in the fourth space Sd and in the first space Sa, which is the space between the inner surface of the housing 12 and the first partition wall 14. A distal end P3*a* of the third pipe P3 may be spaced apart from the base 11 and may be adjacent to the upper surface of the base 11.

The fourth pipe P4 may be vertically connected to the upper side of the gas-liquid separator 10 through a hole in the cap 13, and may be disposed in the internal accommodation space of the housing 12. The fourth pipe P4 may be disposed in the fourth space Sd. A distal end P4*a* of the fourth pipe P4 may be located between the first partition wall 14 and the second partition wall 15 in the horizontal direction. In other words, the distal end P4*a* of the fourth pipe P4 may be located in the fourth space Sd above the second space Sb, which is the space between the first partition wall 14 and the second partition wall 15.

The fifth pipe P5 may be vertically connected to the upper side of the gas-liquid separator 10 through a hole in the cap 13, and may be disposed in the internal accommodation space of the housing 12. The fifth pipe P5 may be disposed in the fourth space Sd and in the third space Sc, which is the space between the inner surface of the housing 12 and the second partition wall 15. A distal end P5*a* of the fifth pipe P5 may be spaced apart from the base 11 and may be adjacent to the upper surface of the base 11.

Figure 4:
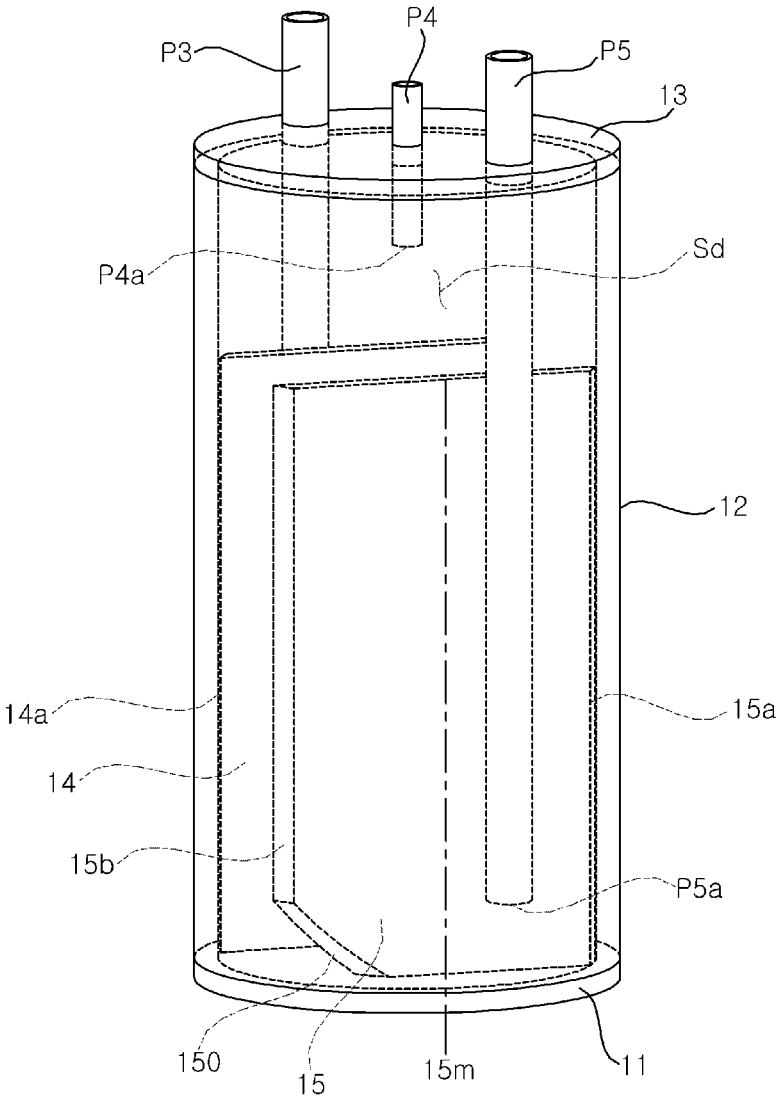

Referring to FIGS. 3 and 4, the first partition wall 14 and the second partition wall 15 may be formed in a plate shape as a whole. A lower surface of the first partition wall 14 may be fixed on the base 11. In a vertical direction, a height Ha of the first partition wall 14 may be smaller than a height Ht of the housing 12. Accordingly, an upper surface of the first partition wall 14 may be located below the cap 13.

The first partition wall 14 may include a first surface 14*a* that contacts the inner surface of the housing 12 in the horizontal direction, and a second surface 14*b* that faces the first surface 14*a* and contacts the inner surface of the housing 12. A point at which the upper surface, the lower surface, the first surface 14*a*, and the second surface 14*b* of the first partition wall 14 meet each other may be referred to as a "corner". More specifically, a point at which the upper surface of the first partition wall 14 and the first surface 14*a* meet may be referred to as a "first corner", a point at which the upper surface of the first partition wall 14 and the second surface 14*b* meet may be referred to as a "second corner", a point at which the lower surface of the first partition wall 14 and the first surface 14*a* meet may be referred to as a "third corner", and a point at which the lower surface of the first partition wall 14 and the second surface 14*b* meet may be referred to as a "fourth corner".

In this case, a first opening 140 may be formed by cutting out a portion of an outer surface of the first partition wall 14. For example, the first opening 140 may be formed by cutting out the fourth corner of the first partition wall 14. Thus, one end of the first opening 140 may be connected to the lower surface of the first partition wall 14 and the other end may be connected to the second surface 14*b*. For example, the first opening 140 may extend in a direction crossing the upper surface of the base 11. In this case, the first opening 140 may form an acute angle with respect to the upper surface of the base 11. Accordingly, the first space Sa and the second space Sb may communicate with each other through the first opening 140.

In addition, the distal end P3*a* of the third pipe P3 may be located closer to the first surface 14*a* than the first opening 140 or the second surface 14*b*. In other words, the distal end P3*a* of the third pipe P3 may be located between a virtual first vertical line 14*m* that passes through a center of the first partition wall 14 and extends in the vertical direction and the first surface 14*a*, and the first opening 140 may be located between the first vertical line 14*m* and the second surface 14*b*.

A lower surface of the second partition wall 15 may be fixed on the base 11. In the vertical direction, a height Ha of the second partition wall 15 may be smaller than the height Ht of the housing 12. Accordingly, an upper surface of the second partition wall 15 may be located below the cap 13.

The second partition wall 15 may include a first surface 15*a* that contacts the inner surface of the housing 12 in the horizontal direction, and a second surface 15*b* that faces the first surface 15*a* and contacts the inner surface of the housing 12. A point at which the upper surface, the lower surface, the first surface 15*a*, and the second surface 15*b* of the second partition wall 15 meet each other may be referred to as a "corner". More specifically, a point at which the upper surface of the second partition wall 15 and the first surface 15*a* meet may be referred to as a "first corner", a point at which the upper surface of the second partition wall 15 and the second surface 15*b* meet may be referred to as a "second corner", a point at which the lower surface of the second partition wall 15 and the first surface 15*a* meet may be referred to as a "third corner", and a point at which the lower surface of the second partition wall 15 and the second surface 15*b* meet may be referred to as a "fourth corner".

In this case, a second opening 150 may be formed by cutting out a portion of an outer surface of the second partition wall 15. For example, the second opening 150 may be formed by cutting out the fourth corner of the second partition wall 15. Accordingly, one end of the second opening 150 may be connected to the lower surface of the second partition wall 15 and the other end may be connected to the second surface 15*b*. For example, the second opening 150 may extend in a direction crossing the upper surface of the base 11. In this case, the second opening 150 may form an acute angle with respect to the upper surface of the base 11. Accordingly, the third space Sc and the second space Sb may communicate with each other through the second opening 150. For example, a direction in which the first opening 140 extends and a direction in which the second opening 150 extends may cross each other.

In addition, a distal end P5*a* of the fifth pipe P5 may be located closer to the first surface 15*a* than the second opening 150 or the second surface 15*b*. In other words, the distal end P5*a* of the fifth pipe P5 may be located between a virtual second vertical line 15*m* that passes through a center of the second partition wall 15 and extends in the vertical direction and the first surface 15*a*, and the second opening 150 may be located between the first vertical line 15*m* and the second surface 15*b*.

A first direction from the first surface 14*a* to the second surface 14*b* of the first partition wall 14 and a second direction from the first surface 15*a* to the second surface 15*b* of the second partition wall 15 may be opposite to each other. Accordingly, the second opening 150 may be formed in a portion that is farthest from the first opening 140 among the lower end of the second partition wall 15. In other words, in the horizontal direction, the first opening 140 and the second opening 150 may face each other, across a circle center of an inner circumferential surface of the housing 12. An inner radius R of the housing 12 may be defined based on the circle center.

In the heating operation mode of the air conditioner, the refrigerant which is expanded while passing through the first expansion valve Va (see FIG. 1) may flow into the first space Sa of the housing 12 in a two-phase state through the third pipe P3. In this case, the third pipe P3 may be referred to as a "refrigerant inflow pipe". In addition, the two-phase refrigerant flowing into the first space Sa may flow along the inner surface of the housing 12, the first partition wall 14, and the second partition wall 15, and may be separated into gas refrigerant and liquid refrigerant.

More specifically, at least a portion of the gas refrigerant, among the two-phase refrigerant discharged from the distal end P3*a* of the third pipe P3, may move upward from the first space Sa toward the fourth space Sd, and may flow into the distal end P4*a* of the fourth pipe P4 and be provided to the compressor 2 (see FIG. 1). In this case, the fourth pipe P4 may be referred to as a "bypass pipe". As the distal end P3*a* of the third pipe P3 is relatively far apart from the first opening 140, it is possible to prevent the gas refrigerant from flowing into the first opening 140.

In addition, among the two-phase refrigerant discharged from the distal end P3*a* of the third pipe P3, the remaining refrigerant excluding the gas refrigerant flowing into the fourth pipe P4 may flow into the second space Sb from the first space Sa through the first opening 140, and may flow into the third space Sc from the second space Sb through the second opening 150 (refer to reference numeral Fa). In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the third space Sc may flow into the distal end P5*a* of the fifth pipe P5, and pass through the above-described second expansion valve Vb, and the indoor heat exchanger 5, for example. In this case, the fifth pipe P5 may be referred to as a "refrigerant discharge pipe".

In the cooling operation mode of the air conditioner, the refrigerant which is expanded while passing through the second expansion valve Vb (see FIG. 1) may flow into the third space Sc of the housing 12 through the fifth pipe P5 in a two-phase state. In this case, the fifth pipe P5 may be referred to as a "refrigerant inflow pipe". In addition, the two-phase refrigerant flowing into the third space Sc may flow along the inner surface of the housing 12, the second partition wall 15, and the first partition wall 14, and may be separated into gas refrigerant and liquid refrigerant.

More specifically, among the two-phase refrigerant discharged from the distal end P5*a* of the fifth pipe P5, at least a portion of the gas refrigerant may move upward from the third space Sc toward the fourth space Sd, and may flow into the distal end P4*a* of the fourth pipe P4 and be provided to the compressor 2 (see FIG. 1). In this case, the fourth pipe P4 may be referred to as a "bypass pipe". As the distal end P5*a* of the fifth pipe P5 is relatively far apart from the second opening 150, the gas refrigerant may be prevented from flowing into the second opening 150.

In addition, the remaining refrigerant excluding the gas refrigerant flowing into the fourth pipe P4, among the two-phase refrigerant discharged from the distal end P5*a* of the fifth pipe P5, may flow into the second space Sb from the third space Sc through the second opening 150, and may flow into the first space Sa from the second space Sb through the first opening 140. In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the first space Sa may flow into the distal end P3*a* of the third pipe P3, and may pass through the above-described first expansion valve Va, and the outdoor heat exchanger 4, for example. In this case, the third pipe P3 may be referred to as a "refrigerant discharge pipe".

Accordingly, gas-liquid separation efficiency in the gas-liquid separator 10 may be increased, and reliability of the compressor may be obtained by preventing the liquid refrigerant from being discharged through the fourth pipe P4. In addition, it is easy to manage a level of the liquid refrigerant, thereby improving performance or efficiency of the air conditioner.

Figure 5:
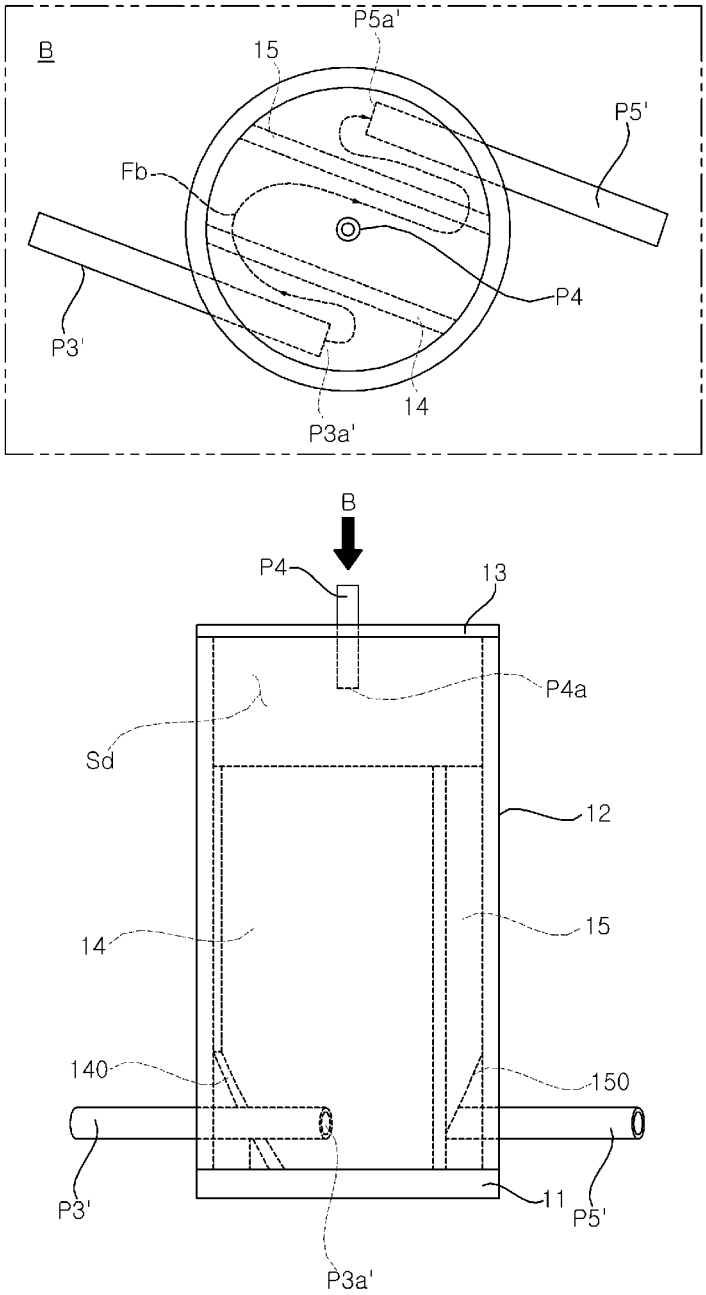
Figure 6:
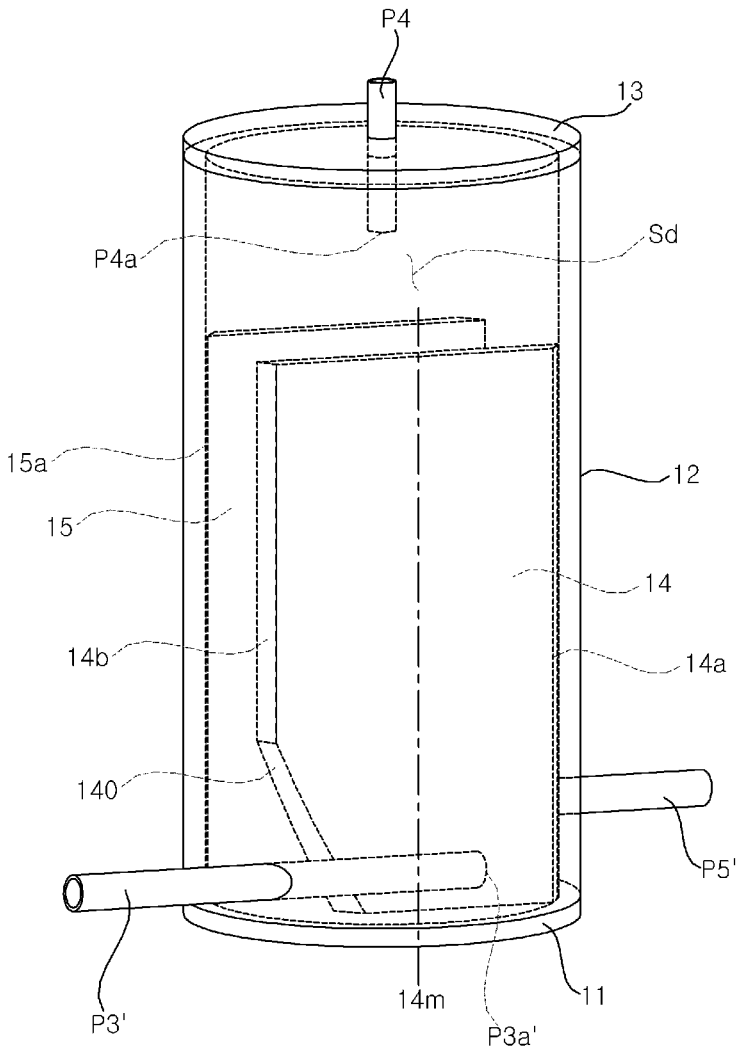

Referring to FIGS. 5 and 6, third pipe P3' and fifth pipe P5' may be horizontally connected to a side surface of gas-liquid separator 10 through a hole formed in the side surface of the gas-liquid separator 10, and may be disposed in the internal accommodation space of the housing 12. The third pipe P3' may be provided with first expansion valve Va (see FIG. 1). The third pipe P3' may be disposed in the first space Sa, which is the space between the inner surface of the housing 12 and the first partition wall 14. The distal end P3*a*' of the third pipe P3' may be spaced apart from the base 11 and may be adjacent to the upper surface of the base 11.

In addition, the distal end P3*a*' of the third pipe P3' may be located closer to the first surface 14*a* than the first opening 140 or the second surface 14*b*. In other words, the distal end P3*a*' of the third pipe P3' may be located between the virtual first vertical line 14*m* that extends in the vertical direction while passing through the center of the first partition wall 14 and the first surface 14*a*, and the first opening 140 may be located between the first vertical line 14*m* and the second surface 14*b*.

The fifth pipe P5' may be provided with second expansion valve Vb (see FIG. 1). The fifth pipe P5' may be disposed in the third space Sc, which is the space between the inner surface of the housing 12 and the second partition wall 15. The distal end P5*a*' of the fifth pipe P5' may be spaced apart from the base 11 and may be adjacent to the upper surface of the base 11.

In addition, the distal end P5*a*' of the fifth pipe P5' may be located closer to the first surface 15*a* than the second opening 150 or the second surface 15*b*. In other words, the distal end P5*a*' of the fifth pipe P5' may be located between the virtual second vertical line 15*m* that extends in the vertical direction while passing through the center of the second partition wall 15 and the first surface 15*a*, and the second opening 150 may be located between the second vertical line 15*m* and the second surface 15*b*.

In the heating operation mode of the air conditioner, the refrigerant which is expanded while passing through the first expansion valve Va (see FIG. 1) may flow into the first space Sa of the housing 12 through the third pipe P3' in a two-phase state. In this case, the third pipe P3' may be referred to as a "refrigerant inflow pipe". In addition, the two-phase refrigerant flowing into the first space Sa may flow along the inner surface of the housing 12, the first partition wall 14, and the second partition wall 15, and may be separated into gas refrigerant and liquid refrigerant.

More specifically, at least a portion of the gas refrigerant, among the two-phase refrigerant discharged from the distal end P3*a*' of the third pipe P3', may move upward from the first space Sa toward the fourth space Sd, and may flow into the distal end P4*a* of the fourth pipe P4 and be provided to the compressor 2 (see FIG. 1). In this case, the fourth pipe P4 may be referred to as a "bypass pipe". As the distal end P3*a*' of the third pipe P3' is relatively far apart from the first opening 140, the gas refrigerant may be prevented from flowing to the first opening 140.

In addition, among the two-phase refrigerant discharged from the distal end P3*a*' of the third pipe P3', the remaining refrigerant excluding the gas refrigerant flowing into the fourth pipe P4 may flow into the second space Sb from the first space Sa through the first opening 140, and may flow into the third space Sc from the second space Sb through the second opening 150 (refer to reference numeral Fb). In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the third space Sc may flow into the distal end P5*a*' of the fifth pipe P5', and pass through the above-described second expansion valve Vb, and the indoor heat exchanger 5, for example. In this case, the fifth pipe P5' may be referred to as a "refrigerant discharge pipe".

In the cooling operation mode of the air conditioner, the refrigerant which is expanded while passing through the second expansion valve Vb (see FIG. 1) may flow into the third space Sc of the housing 12 through the fifth pipe P5' in a two-phase state. In this case, the fifth pipe P5' may be referred to as a "refrigerant inflow pipe". In addition, the two-phase refrigerant flowing into the third space Sc may flow along the inner surface of the housing 12, the second partition wall 15, and the first partition wall 14, and may be separated into gas refrigerant and liquid refrigerant.

More specifically, among the two-phase refrigerant discharged from the distal end P5*a*' of the fifth pipe P5', at least a portion of the gas refrigerant may move upward from the third space Sc toward the fourth space Sd, and may flow into the distal end P4*a* of the fourth pipe P4 and be provided to the compressor 2 (see FIG. 1). In this case, the fourth pipe P4 may be referred to as a "bypass pipe". As the distal end P5*a*' of the fifth pipe P5' is relatively far apart from the second opening 150, the gas refrigerant may be prevented from flowing into the second opening 150.

In addition, the remaining refrigerant excluding the gas refrigerant flowing into the fourth pipe P4, among the two-phase refrigerant discharged from the distal end P5*a* of the fifth pipe P5, may flow into the second space Sb from the third space Sc through the second opening 150, and may flow into the first space Sa from the second space Sb through the first opening 140. In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the first space Sa may flow into the distal end P3*a*' of the third pipe P3', and may pass through the above-described first expansion valve Va, and the outdoor heat exchanger 4, for example. In this case, the third pipe P3' may be referred to as a "refrigerant discharge pipe".

Accordingly, gas-liquid separation efficiency in the gas-liquid separator 10 may be increased, and reliability of the compressor may be obtained by preventing the liquid refrigerant from being discharged through the fourth pipe P4. In addition, it is easy to manage a level of the liquid refrigerant, thereby improving performance or efficiency of the air conditioner.

Figure 7:
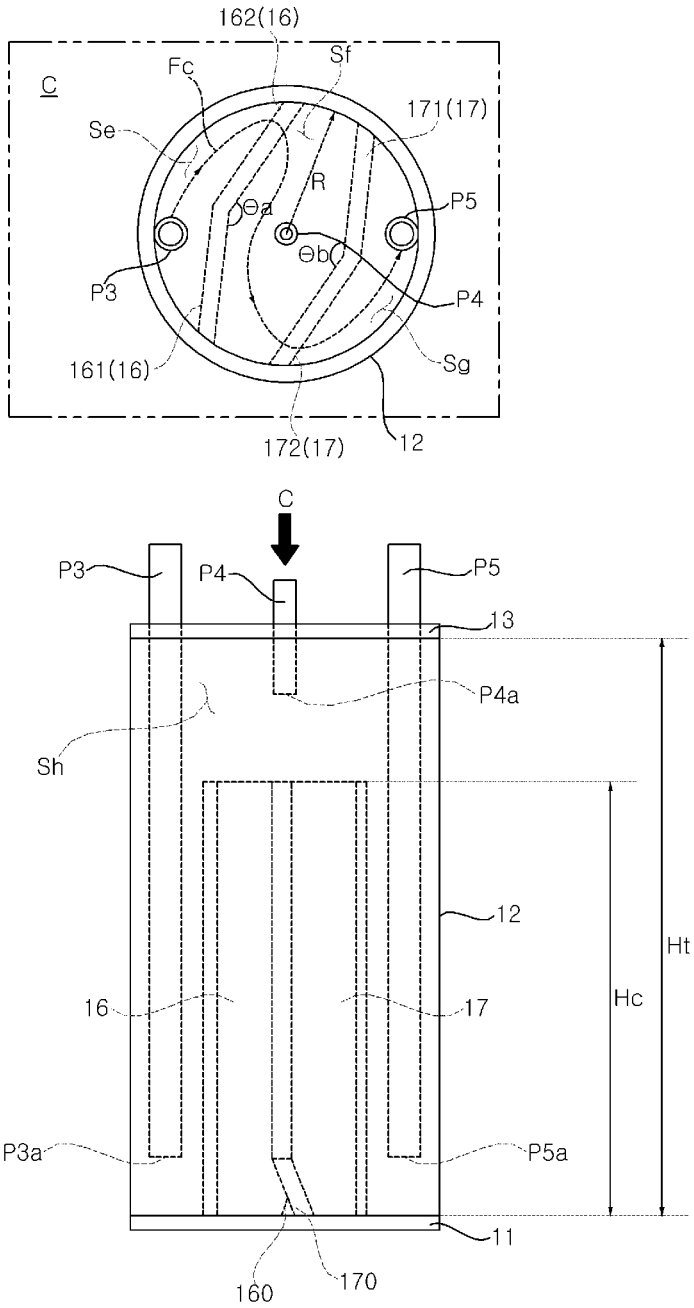

Referring to FIG. 7, gas-liquid separator 10 may include a first partition wall 16 and a second partition wall 17. The first partition wall 16 and the second partition wall 17 may be installed in the internal accommodation space of the housing 12. The first partition wall 16 and the second partition wall 17 may be spaced apart from each other. A lower end of the first partition wall 16 and a lower end of the second partition wall 17 may be fixed on the base 11. A side surface of the first partition wall 16 and a side surface of the second partition wall 17 may be fixed to the inner surface of the housing 12. An upper end of the first partition wall 16 and an upper end of the second partition wall 17 may be spaced apart from the lower surface of the cap 13.

Accordingly, the first partition wall 16 and the second partition wall 17 may divide the internal accommodation space of the housing 12 in the horizontal direction into a first space Se, which is a space between the first partition wall 16 and the inner surface of the housing 12, a second space Sf, which is a space between the first partition wall 16 and the second partition wall 17, and a third space Sg, which is a space between the second partition wall 17 and the inner surface of the housing 12. In addition, a fourth space Sh may be formed between the lower surface of the cap 13 and the first and second partition walls 16 and 17.

Figure 8:
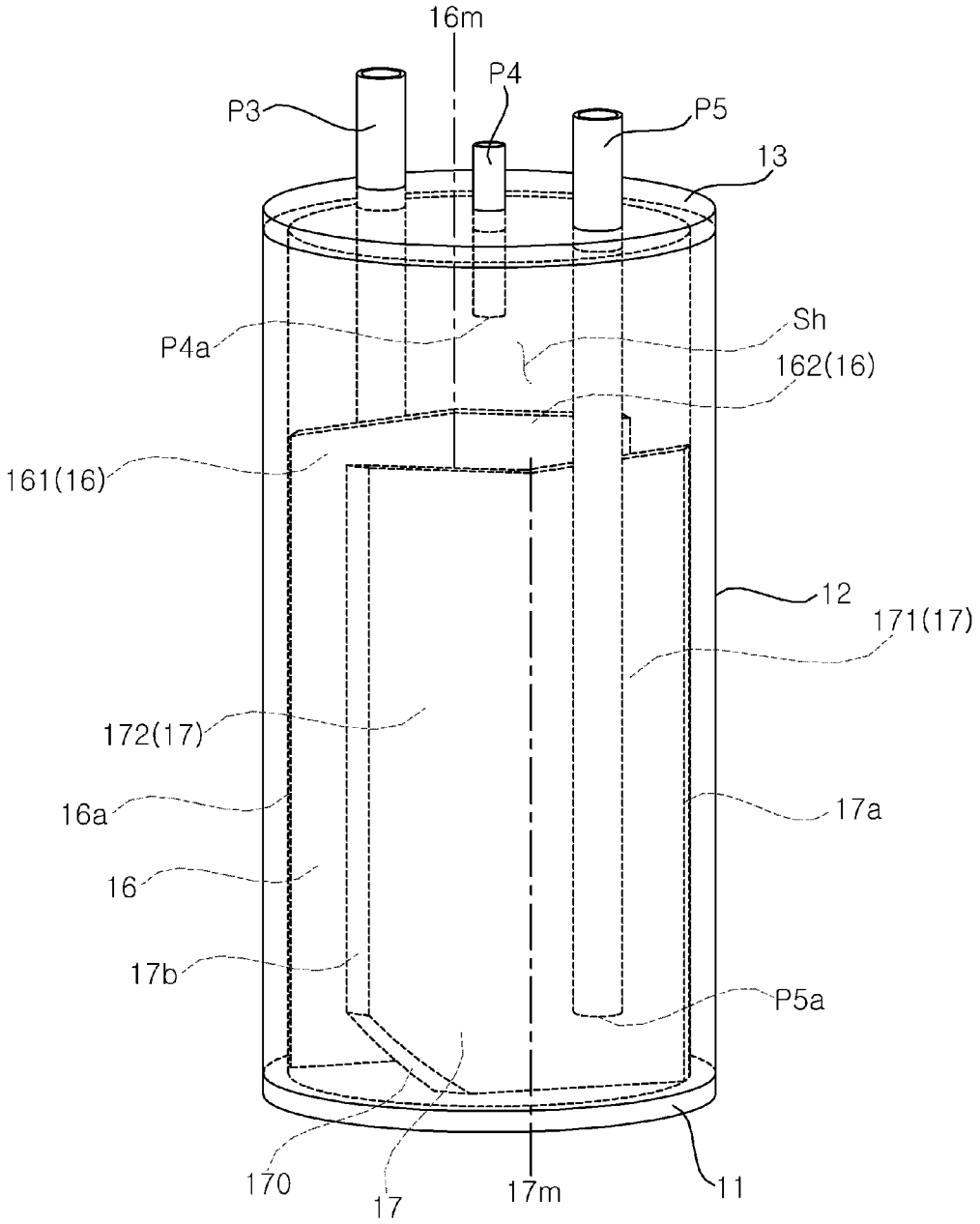

Referring to FIGS. 7 and 8, the first partition wall 16 and the second partition wall 17 may be formed as a whole in a plate shape which is bent at least once in a radial direction of the housing 12.

The lower surface of the first partition wall 16 may be fixed on the base 11. In the vertical direction, a height Hc of the first partition wall 16 may be smaller than the height Ht of the housing 12. Accordingly, the upper surface of the first partition wall 16 may be located below the cap 13.

The first partition wall 16 may include a first plate 161 and a second plate 162. The first plate 161 and the second plate 162 may be coupled to each other along a virtual first vertical line 16*m* extending in the vertical direction while passing through a center of the first partition wall 16. Each of the first plate 161 and the second plate 162 may be formed flat. The second plate 162 may be inclined at a predetermined angle (ea) with respect to the first plate 161. For example, ea may be an obtuse angle.

The first partition wall 16 may include a first surface 16*a* that contacts the inner surface of the housing 12 in the horizontal direction, and a second surface 16*b* that faces the first surface 16*a* and contacts the inner surface of the housing 12. In this case, the first surface 16*a* may be provided on the first plate 161 and the second surface 16*b* may be provided on the second plate 162.

A point at which the upper surface, the lower surface, the first surface 16*a*, and the second surface 16*b* of the first partition wall 16 meet each other may be referred to as a "corner". More specifically, a point at which the upper surface of the first partition wall 16 and the first surface 16*a* meet may be referred to as a "first corner", a point at which the upper surface of the first partition wall 16 and the second surface 16*b* meet may be referred to as a "second corner", a point at which the lower surface of the first partition wall 16 and the first surface 16*a* meet may be referred to as a "third corner", and a point at which the lower surface of the first partition wall 16 and the second surface 16*b* meet may be referred to as a "fourth corner". In this case, the first corner and the third corner may be provided in the first plate 161 and the second corner and the fourth corner may be provided in the second plate 162.

In this case, a first opening 160 may be formed by cutting out a portion of an outer surface of the first partition wall 16. For example, the first opening 160 may be formed by cutting out the fourth corner of the first partition wall 16. Thus, one end of the first opening 160 may be connected to the lower surface of the first partition wall 16 and the other end may be connected to the second surface 16*b*. For example, the first opening 160 may extend in a direction crossing the upper surface of the base 11. In this case, the first opening 160 may form an acute angle with respect to the upper surface of the base 11. Accordingly, the first space Se and the second space Sf may communicate with each other through the first opening 160.

In addition, the distal end P3*a* of the third pipe P3 may be located closer to the first surface 16*a* than the first opening 160 or the second surface 16*b*. In other words, the distal end P3*a* of the third pipe P3 may be located closer to the first plate 161 than the second plate 162.

A lower surface of the second partition wall 17 may be fixed on the base 11. In the vertical direction, a height Ha of the second partition wall 17 may be smaller than the height Ht of the housing 12. Accordingly, the upper surface of the second partition wall 17 may be located below the cap 13.

The second partition wall 17 may include a first plate 171 and a second plate 172. The first plate 171 and the second plate 172 may be coupled to each other along a virtual second vertical line 17*m* extending in the vertical direction while passing through a center of the second partition wall 17. Each of the first plate 171 and the second plate 172 may be formed flat. The second plate 172 may be inclined at a predetermined angle ($\theta_b$) with respect to the first plate 171. For example, $\theta_b$ may be an obtuse angle.

The second partition wall 17 may include a first surface 17*a* that contacts the inner surface of the housing 12 in the horizontal direction, and a second surface 17*b* that faces the first surface 17*a* and contacts the inner surface of the housing 12. In this case, the first surface 17*a* may be provided on the first plate 171 and the second surface 17*b* may be provided on the second plate 172.

A point at which the upper surface, the lower surface, the first surface 17*a*, and the second surface 17*b* of the second partition wall 17 meet each other may be referred to as a "corner". More specifically, a point at which the upper surface of the second partition wall 17 and the first surface 17*a* meet may be referred to as a "first corner", a point at which the upper surface of the second partition wall 17 and the second surface 17*b* meet may be referred to as a "second corner", a point at which the lower surface of the second partition wall 17 and the first surface 17*a* meet may be referred to as a "third corner", and a point at which the lower surface of the second partition wall 17 and the second surface 17*b* meet may be referred to as a "fourth corner". At this time, the first corner and the third corner may be provided in the first plate 171, and the second corner and the fourth corner may be provided in the second plate 172.

In this case, a second opening 170 may be formed by cutting out a portion of an outer surface of the second partition wall 17. For example, the second opening 170 may be formed by cutting out the fourth corner of the second partition wall 17. Thus, one end of the second opening 170 may be connected to the lower surface of the second partition wall 17 and the other end may be connected to the second surface 17*b*. For example, the second opening 170 may extend in a direction crossing the upper surface of the base 11. In this case, the second opening 170 may form an acute angle with respect to the upper surface of the base 11. Thus, the third space Sg and the second space Sf may communicate with each other through the second opening 170. For example, a direction in which the first opening 160 extends and a direction in which the second opening 170 extends may cross each other.

In addition, a distal end P5*a* of the fifth pipe P5 may be located closer to the first surface 17*a* than the second opening 170 or the second surface 17*b*. In other words, the distal end P5*a* of the fifth pipe P5 may be located closer to the first plate 171 than the second plate 172.

A first direction from the first surface 16*a* toward the second surface 16*b* in the first partition wall 16 and a second direction from the first surface 17*a* toward the second surface 17*b* in the second partition wall 17 may be opposite to each other. Thus, the second opening 170 may be formed in a portion which is farthest from the first opening 160 among the lower end of the second partition wall 17. In other words, in the horizontal direction, the first opening 160 and the second opening 170 may face each other, across a circle center of the inner circumferential surface of the housing 12. The inner radius R of the housing 12 may be defined based on the circle center.

In the heating operation mode of the air conditioner, the refrigerant which is expanded while passing through the first expansion valve Va (see FIG. 1) may flow into the first space Sa of the housing 12 through the third pipe P3 in a two-phase state. In this case, the third pipe P3 may be referred to as a "refrigerant inflow pipe". In addition, the two-phase refrigerant flowing into the first space Sa may flow along the inner surface of the housing 12, the first partition wall 16, and the second partition wall 17, and may be separated into gas refrigerant and liquid refrigerant.

More specifically, at least a portion of the gas refrigerant, among the two-phase refrigerant discharged from the distal end P3*a* of the third pipe P3, may move upward from the first space Se toward the fourth space Sh, and may flow into the distal end P4*a* of the fourth pipe P4 and be provided to the compressor 2 (see FIG. 1). In this case, the fourth pipe P4 may be referred to as a "bypass pipe". As the distal end P3*a* of the third pipe P3 is relatively far apart from the first opening 160, the gas refrigerant may be prevented from flowing into the first opening 160. In addition, due to the plate shape which is bent once in the radial direction of the housing 12 of the first partition wall 16, the liquid refrigerant, among the two-phase refrigerant discharged from the distal end P3*a* of the third pipe P3, may be prevented from flowing into the distal end P4*a* of the fourth pipe P4 through the fourth space Sh.

In addition, among the two-phase refrigerant discharged from the distal end P3*a* of the third pipe P3, the remaining refrigerant excluding the gas refrigerant flowing into the fourth pipe P4 may flow into the second space Sf from the first space Se through the first opening 160, and may flow into the third space Sg from the second space Sf through the second opening 170 (refer to reference numeral Fc). In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the third space Sg may flow into the distal end P5*a* of the fifth pipe P5, and may pass through the above-described second expansion valve Vb, and the indoor heat exchanger 5, for example. At this time, the fifth pipe P5 may be referred to as a "refrigerant discharge pipe".

In the cooling operation mode of the air conditioner, the refrigerant which is expanded while passing through the second expansion valve Vb (see FIG. 1) may flow into the third space Sc of the housing 12 through the fifth pipe P5 in a two-phase state. At this time, the fifth pipe P5 may be referred to as a "refrigerant inflow pipe". In addition, the two-phase refrigerant flowing into the third space Sg may flow along the inner surface of the housing 12, the second partition wall 17, and the first partition wall 16, and may be separated into gas refrigerant and liquid refrigerant.

More specifically, among the two-phase refrigerant discharged from the distal end P5*a* of the fifth pipe P5, at least a portion of the gas refrigerant may move upward from the third space Sg toward the fourth space Sh, and may flow into the distal end P4*a* of the fourth pipe P4 and be provided to the compressor 2 (see FIG. 1). At this time, the fourth pipe P4 may be referred to as a "bypass pipe". As the distal end P5*a* of the fifth pipe P5 is relatively far apart from the second opening 170, the gas refrigerant may be prevented from flowing into the second opening 170. In addition, due to the plate shape which is bent once in the radial direction of the housing 12 of the second partition wall 17, among the two-phase refrigerant discharged from the distal end P5*a* of the fifth pipe P5, the liquid refrigerant may be prevented from flowing into the distal end P4*a* of the fourth pipe P4 through the fourth space Sh.

In addition, the remaining refrigerant excluding the gas refrigerant flowing into the fourth pipe P4, among the two-phase refrigerant discharged from the distal end P5*a* of the fifth pipe P5, may flow into the second space Sf through the second opening 170 from the third space Sg, and may flow into the first space Se through the first opening 160 from the second space Sf. In this case, the gas refrigerant included in the remaining refrigerant during the above-described refrigerant flow process may move upward toward the fourth space Sh, and may flow into the distal end P4*a* of the fourth pipe P4. As a result, the liquid refrigerant flowing into the first space Se may flow into the distal end P3*a* of the third pipe P3, and may pass through the above-described first expansion valve Va, and the outdoor heat exchanger 4, for example. At this time, the third pipe P3 may be referred to as a "refrigerant discharge pipe".

Accordingly, gas-liquid separation efficiency in the gas-liquid separator 10 may be increased, and reliability of the compressor may be obtained by preventing the liquid refrigerant from being discharged through the fourth pipe P4. In addition, it is easy to manage the level of the liquid refrigerant, thereby improving performance or efficiency of the air conditioner.

Figure 9:
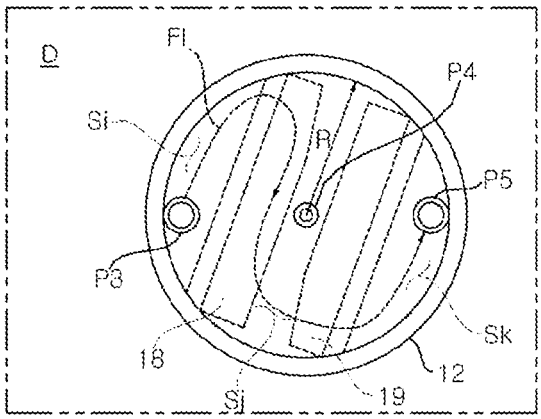
Figure 9:
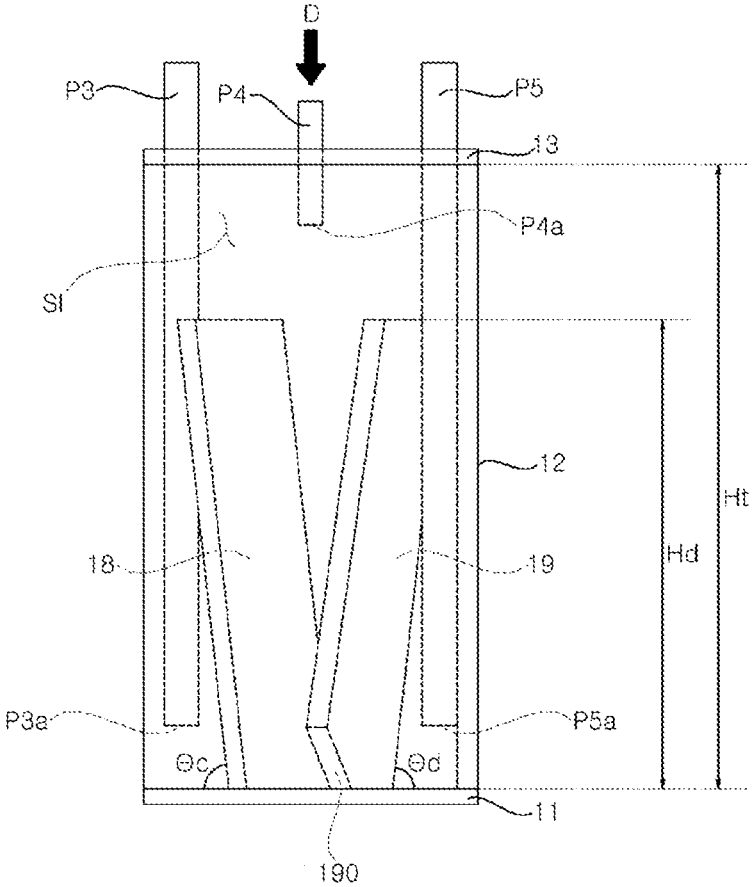

Referring to FIG. 9, gas-liquid separator 10 may include a first partition wall 18 and a second partition wall 19. The first partition wall 18 and the second partition wall 19 may be installed in the internal accommodation space of the housing 12. The first partition wall 18 and the second partition wall 19 may be spaced apart from each other. A lower end of the first partition wall 18 and a lower end of the second partition wall 19 may be fixed on the base 11. A side surface of the first partition wall 18 and a side surface of the second partition wall 19 may be fixed to the inner surface of the housing 12. An upper end of the first partition wall 18 and an upper end of the second partition wall 19 may be spaced apart from the lower surface of the cap 13.

Accordingly, the first partition wall 18 and the second partition wall 19 may divide the internal accommodation space of the housing 12 in the horizontal direction into a first space Si, which is a space between the first partition wall 18 and the inner surface of the housing 12, a second space Sj, which is a space between the first partition wall 18 and the second partition wall 19, and a third space Sk, which is a space between the second partition wall 19 and the inner surface of the housing 12. In addition, a fourth space SI may be formed between the lower surface of the cap 13 and the first and second partition walls 16 and 17.

Figure 10:
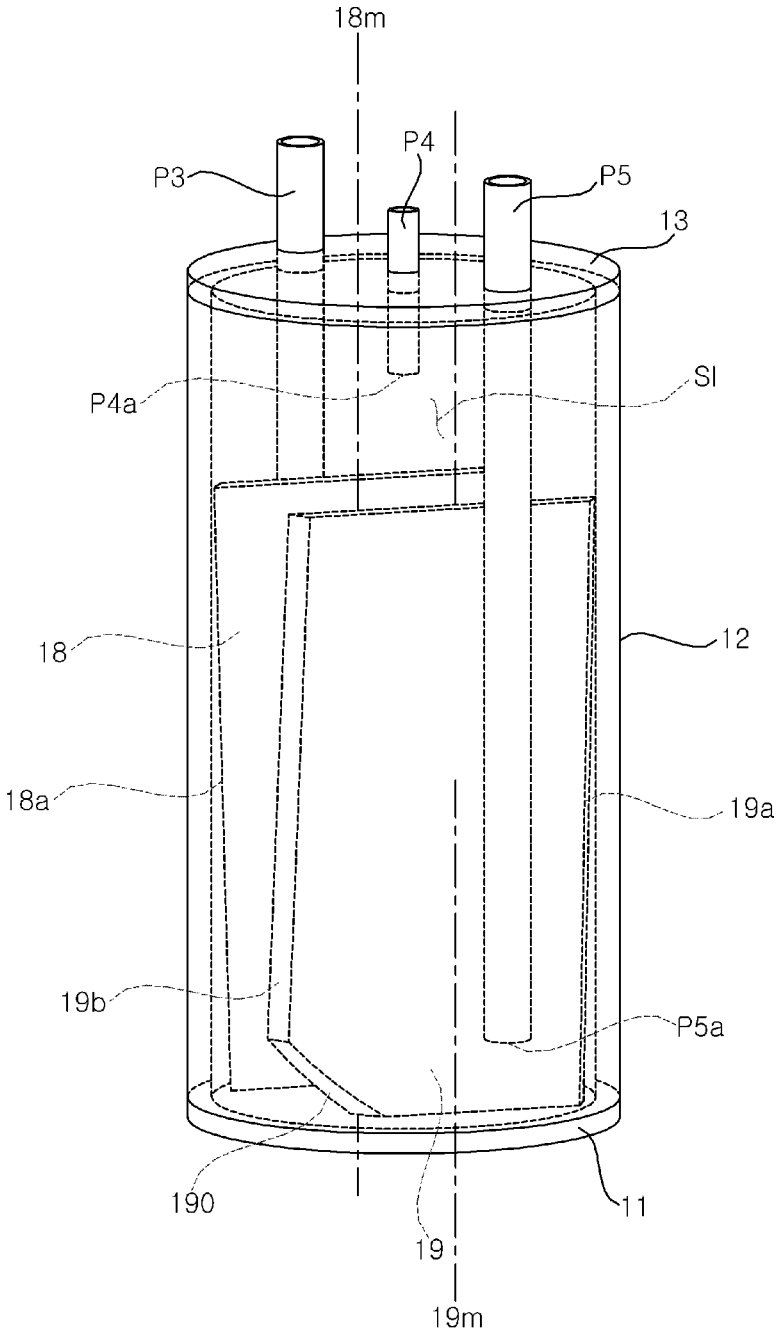

Referring to FIGS. 9 and 10, the first partition wall 18 and the second partition wall 19 may be formed as a whole in a plate shape, and may be inclined with respect to the base 11.

A lower surface of the first partition wall 18 may be fixed on the base 11. In the vertical direction, a height Hc of the first partition wall 18 may be smaller than the height Ht of the housing 12. Accordingly, an upper surface of the first partition wall 18 may be located below the cap 13.

The first partition wall 18 may extend lengthwise in a direction crossing the base 11. The first partition wall 18 may be inclined at a predetermined angle ($\theta_c$) with respect to the base 11. For example, $\theta_c$ may be an acute angle. In this case, the lower end of the first partition wall 18 may be spaced apart from the inner surface of the housing 12, and the upper end of the first partition wall 18 may contact the inner surface of the housing 12.

The first partition wall 18 may include a first surface 18*a* that contacts the inner surface of the housing 12 in the horizontal direction, and a second surface 18*b* that faces the first surface 18*a* and contacts the inner surface of the housing 12. A point at which the upper surface, the lower surface, the first surface 18*a*, and the second surface 18*b* of the first partition wall 18 meet each other may be referred to as a "corner". More specifically, a point at which the upper surface of the first partition wall 18 and the first surface 18*a* meet may be referred to as a "first corner", a point at which the upper surface of the first partition wall 18 and the second surface 18*b* meet may be referred to as a "second corner", a point at which the lower surface of the first partition wall 18 and the first surface 18*a* meet may be referred to as a "third corner", and a point at which the lower surface of the first partition wall 18 and the second surface 18*b* meet may be referred to as a "fourth corner".

In this case, a first opening 180 may be formed by cutting out a portion of an outer surface of the first partition wall 18. For example, the first opening 180 may be formed by cutting out the fourth corner of the first partition wall 18. Thus, one end of the first opening 180 may be connected to the lower surface of the first partition wall 18 and the other end may be connected to the second surface 18*b*. For example, the first opening 180 may extend in a direction crossing the upper surface of the base 11. In this case, the first opening 180 may form an acute angle with respect to the upper surface of the base 11. Accordingly, the first space Si and the second space Sj may communicate with each other through the first opening 180.

In addition, the distal end P3*a* of the third pipe P3 may be located closer to the first surface 18*a* than the first opening 180 or the second surface 18*b*. In other words, the distal end P3*a* of the third pipe P3 may be located between the first virtual line 18*m* extending in the vertical direction while passing through a center of the first partition wall 18 and the first surface 18*a*, and the first opening 180 may be located between the first vertical line 18*m* and the second surface 18*b*.

The lower surface of the second partition wall 19 may be fixed on the base 11. In the vertical direction, a height Ha of the second partition wall 19 may be smaller than the height Ht of the housing 12. Accordingly, the upper surface of the second partition wall 19 may be located below the cap 13.

The second partition wall 19 may extend lengthwise in a direction crossing the base 11. The second partition wall 19 may be inclined at a predetermined angle ($\theta_d$) with respect to the base 11. For example, $\theta_d$ may be an acute angle. In this case, the lower end of the second partition wall 19 may be spaced apart from the inner surface of the housing 12, and the upper end of the second partition wall 19 may contact the inner surface of the housing 12.

The second partition wall 19 may include a first surface 19*a* that contacts the inner surface of the housing 12 in the horizontal direction, and a second surface 19*b* that faces the first surface 19*a* and contacts the inner surface of the housing 12. A point at which the upper surface, the lower surface, the first surface 19*a*, and the second surface 19*b* of the second partition wall 19 meet each other may be referred to as a "corner". More specifically, a point at which the upper surface of the second partition wall 19 and the first surface 19*a* meet may be referred to as a "first corner", a point at which the upper surface of the second partition wall 19 and the second surface 19*b* meet may be referred to as a "second corner", a point at which the lower surface of the second partition wall 19 and the first surface 19*a* meet may be referred to as a "third corner", and a point at which the lower surface of the second partition wall 19 and the second surface 19*b* meet may be referred to as a "fourth corner".

In this case, a second opening 190 may be formed by cutting out a portion of an outer surface of the second partition wall 19. For example, the second opening 190 may be formed by cutting out the fourth corner of the second partition wall 19. Thus, one end of the second opening 190 may be connected to the lower surface of the second partition wall 19 and the other end may be connected to the second surface 19*b*. For example, the second opening 190 may extend in a direction crossing the upper surface of the base 11. In this case, the second opening 190 may form an acute angle with respect to the upper surface of the base 11. Thus, the third space Sk and the second space Sj may communicate with each other through the second opening 190. For example, a direction in which the first opening 180 extends and a direction in which the second opening 190 extends may cross each other.

In addition, a distal end P5*a* of the fifth pipe P5 may be located closer to the first surface 19*a* than the second opening 190 or the second surface 19*b*. In other words, the distal end P5*a* of the fifth pipe P5 may be located between a virtual second vertical line 19*m* extending in the vertical direction while passing through a center of the second partition wall 19 and the first surface 19*a*, and the second opening 190 may be located between the second vertical line 19*m* and the second surface 19*b*.

A first direction from the first surface 18*a* of the first partition wall 18 toward the second surface 18*b* and a second direction from the first surface 19*a* of the second partition wall 19 toward the second surface 19*b* may be opposite to each other. Thus, the second opening 190 may be formed in a portion which is farthest from the first opening 180 among the lower end of the second partition wall 19. In other words, in the horizontal direction, the first opening 180 and the second opening 190 may face each other, across a circle center of the inner circumferential surface of the housing 12. The inner radius R of the housing 12 may be defined based on the circle center.

In the heating operation mode of the air conditioner, the refrigerant which is expanded while passing through the first expansion valve Va (see FIG. 1) may flow into the first space Si of the housing 12 through the third pipe P3 in a two-phase state. In this case, the third pipe P3 may be referred to as a "refrigerant inflow pipe". In addition, the two-phase refrigerant flowing into the first space Si may flow along the inner surface of the housing 12, the first partition wall 18, and the second partition wall 19, and may be separated into gas refrigerant and liquid refrigerant.

More specifically, at least a portion of the gas refrigerant, among the two-phase refrigerants discharged from the distal end P3*a* of the third pipe P3, may move upward from the first space Si toward the fourth space SI, and may flow into the distal end P4*a* of the fourth pipe P4 and be provided to the compressor 2 (see FIG. 1). At this case, the fourth pipe P4 may be referred to as a "bypass pipe". As the distal end P3*a* of the third pipe P3 is relatively far apart from the first opening 180, the gas refrigerant may be prevented from flowing into the first opening 180. In addition, due to the configuration in which the first partition wall 18 is inclined toward the inner surface of the housing 12 as it extends upward from the base 11, the liquid refrigerant, among the two-phase refrigerant discharged from the distal end P3*a* of the third pipe P3, may be prevented from flowing into the distal end P4*a* of the fourth pipe P4 through the fourth space SI.

In addition, among the two-phase refrigerant discharged from the distal end P3*a* of the third pipe P3, the remaining refrigerant excluding the gas refrigerant flowing into the fourth pipe P4 may flow into the second space Sj from the first space Si through the first opening 180, and may flow into the third space Sk from the second space Sj through the second opening 190 (refer to reference numeral F1). In this case, the gas refrigerant included in the remaining refrigerant during the above-described refrigerant flow process may move upward toward the fourth space Sd, and may flow into the distal end P4*a* of the fourth pipe P4. As a result, the liquid refrigerant flowing into the third space Sk may flow into the distal end P5*a* of the fifth pipe P5, and may pass through the above-described second expansion valve Vb, and the indoor heat exchanger 5, for example. At this time, the fifth pipe P5 may be referred to as a "refrigerant discharge pipe".

In the cooling operation mode of the air conditioner, the refrigerant which is expanded while passing through the second expansion valve Vb (see FIG. 1) may flow into the third space Sk of the housing 12 through the fifth pipe P5 in a two-phase state. At this time, the fifth pipe P5 may be referred to as a "refrigerant inflow pipe". In addition, the two-phase refrigerant flowing into the third space Sk may flow along the inner surface of the housing 12, the second partition wall 19, and the first partition wall 18, and may be separated into gas refrigerant and liquid refrigerant.

More specifically, among the two-phase refrigerant discharged from the distal end P5*a* of the fifth pipe P5, at least a portion of the gas refrigerant may move upward from the third space Sk toward the fourth space SI, and may flow into the distal end P4*a* of the fourth pipe P4 and be provided to the compressor 2 (see FIG. 1). At this time, the fourth pipe P4 may be referred to as a "bypass pipe". As the distal end P5*a* of the fifth pipe P5 is relatively far apart from the second opening 190, the gas refrigerant may be prevented from flowing into the second opening 190. In addition, due to the configuration in which the second partition wall 19 is inclined toward the inner surface of the housing 12 as it extends upward from the base 11, the liquid refrigerant, among the two-phase refrigerant discharged from the distal end P5*a* of the fifth pipe P5, may be prevented from flowing into the distal end P4*a* of the fourth pipe P4 through the fourth space SI.

In addition, the remaining refrigerant excluding the gas refrigerant flowing into the fourth pipe P4, among the two-phase refrigerant discharged from the distal end P5*a* of the fifth pipe P5, may flow into the second space Sj through the second opening 190 from the third space Sk, and may flow into the first space Si through the first opening 180 from the second space Sj. In this case, the gas refrigerant included in the remaining refrigerant during the above-described refrigerant flow process may move upward toward the fourth space SI, and may flow into the distal end P4*a* of the fourth pipe P4. As a result, the liquid refrigerant flowing into the first space Si may flow into the distal end P3*a* of the third pipe P3, and may pass through the above-described first expansion valve Va, and the outdoor heat exchanger 4, for example. At this time, the third pipe P3 may be referred to as a "refrigerant discharge pipe".

Accordingly, gas-liquid separation efficiency in the gas-liquid separator 10 may be increased, and reliability of the compressor may be obtained by preventing the liquid refrigerant from being discharged through the fourth pipe P4. In addition, it is easy to manage the level of the liquid refrigerant, thereby improving performance or efficiency of the air conditioner.

According to embodiments disclosed herein, an air conditioner is provided that may include a compressor that compresses a refrigerant; a condenser that condenses the refrigerant discharged from the compressor; an expansion valve that expands the refrigerant passing through the condenser; a gas-liquid separator, through which the refrigerant passed through the expansion valve may flow, that separates and discharges the refrigerant flowing into the gas-liquid separator into gas refrigerant and liquid refrigerant; an evaporator that evaporates the liquid refrigerant discharged from the gas-liquid separator; a refrigerant inflow pipe that connects the expansion valve and the gas-liquid separator; a bypass pipe that connects the gas-liquid separator and the compressor; and a refrigerant discharge pipe that connects the gas-liquid separator and the evaporator. The gas-liquid separator may include a housing in which the refrigerant inflow pipe, the bypass pipe, and the refrigerant discharge pipe may be disposed; a first partition wall, which is disposed in an internal space of the housing and including a first opening formed by cutting out a part or portion of an outer surface thereof, that is disposed adjacent to the refrigerant inflow pipe, and a second partition wall, which is spaced apart from the first partition wall and disposed in the internal space of the housing and includes a second opening formed by cutting out a part or portion of an outer surface thereof, that is disposed adjacent to the refrigerant discharge pipe.

The first partition wall and the second partition wall may divide a first space, which is a space between the first partition wall and an inner surface of the housing, a second space, which is a space between the first partition wall and the second partition wall, and a third space, which is a space between the second partition wall and an inner surface of the housing. The refrigerant inflow pipe may be disposed in the first space, and the refrigerant discharge pipe may be disposed in the third space.

The gas-liquid separator may further include a base to which a lower end of the first partition wall and a lower end of the second partition wall may be fixed. The first opening may extend in a direction crossing an upper surface of the base, and may have one end connected to the lower end of the first partition wall. The second opening may extend in a direction crossing the upper surface of the base, and may have one end connected to the lower end of the second partition wall.

The refrigerant inflow pipe may be adjacent to the upper surface of the base and may have a distal end spaced apart from the first opening. The refrigerant discharge pipe may be adjacent to the upper surface of the base and may have a distal end spaced apart from the second opening.

The one end of the first opening may be formed in a portion, among the lower end of the first partition wall, which is farthest from the lower end of the second partition wall. The one end of the second opening may be formed in a portion, among the lower end of the second partition wall, which is farthest from the lower end of the first partition wall. A direction in which the first opening extends and a direction in which the second opening extends may cross each other.

The housing may be formed in a cylindrical shape. Further, each of the first partition wall and second partition wall may be bent at least once in a radial direction of the housing. Each of the first partition wall and second partition wall may be inclined while forming an acute angle with respect to the base.

The gas-liquid separator may further include a cap which is spaced upward from the first partition wall and the second partition wall and is coupled to an upper end of the housing. The bypass pipe may be installed in the cap, and may have a distal end disposed in a fourth space located above the second space and below the cap.

The bypass pipe may be connected in a vertical direction of the housing. Each of the refrigerant inflow pipe and the refrigerant discharge pipe may be connected to the housing in a vertical direction or in a horizontal direction.

An air conditioner according to embodiments has at least the following advantages.

According to embodiments disclosed herein, it is possible to provide an air conditioner capable of increasing a separation rate of gas refrigerant and liquid refrigerant by providing a partition wall in a gas-liquid separator. Further, according to embodiments disclosed herein, it is possible to provide an air conditioner capable of obtaining reliability of a compressor by preventing liquid refrigerant from being discharged into a bypass pipe through which gas refrigerant separated in the gas-liquid separator flows. Furthermore, according to embodiments disclosed herein, it is possible to provide various embodiments of a structure of a partition wall provided in a gas-liquid separator.

Embodiments disclosed herein provide an air conditioner capable of increasing a separation rate of gas refrigerant and liquid refrigerant by providing a partition wall in a gas-liquid separator. Embodiments disclosed herein further provide an air conditioner capable of obtaining reliability of a compressor by preventing liquid refrigerant from being discharged into a bypass pipe through which gas refrigerant separated in the gas-liquid separator flows. Embodiments disclosed herein furthermore provide various embodiments of structure of a partition wall provided in a gas-liquid separator.

In accordance with embodiments disclosed herein, an air conditioner may include a compressor that compresses a refrigerant; a condenser that condenses the refrigerant discharged from the compressor; an expansion valve that expands the refrigerant passing through the condenser; a gas-liquid separator, through which the refrigerant passed through the expansion valve flows, that separates and discharges the refrigerant flowing into the gas-liquid separator into gas refrigerant and liquid refrigerant; an evaporator that evaporates the liquid refrigerant discharged from the gas-liquid separator; a refrigerant inflow pipe that connects the expansion valve and the gas-liquid separator; a bypass pipe that connects the gas-liquid separator and the compressor; and a refrigerant discharge pipe that connects the gas-liquid separator and the evaporator. The gas-liquid separator may include a housing in which the refrigerant inflow pipe, the bypass pipe, and the refrigerant discharge pipe may be disposed; a first partition wall, which is disposed in an internal space of the housing, and includes a first opening formed by cutting out a portion of an outer surface thereof, that is disposed adjacent to the refrigerant inflow pipe, and a second partition wall, which is spaced apart from the first partition wall and disposed in the internal space of the housing and includes a second opening formed by cutting out a portion of an outer surface thereof, that is disposed adjacent to the refrigerant discharge pipe.

Additional scope of applicability will become apparent from the description. However, various changes and modifications within the spirit and scope may be clearly understood by those skilled in the art, and thus, description and specific embodiments should be understood as being given by way of example only.

Certain or other embodiments described above are not mutually exclusive or distinct from each other. Certain or other embodiments described above may have configurations or functions used in combination or jointly.

For example, it means that a configuration A described in a specific embodiment and/or drawing may be combined with a configuration B described in another embodiment and/or drawing. That is, even if the combination of configurations is not directly described, the combination is possible except for the case where the combination is described to be impossible.

The above detailed description should not be construed as restrictive in all respects and should be considered as illustrative. The scope should be determined by rational interpretation of the appended claims, and all changes within the equivalent scope are included in the scope.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a compressor that compresses a refrigerant;

a condenser that condenses the refrigerant discharged from the compressor;

at least one expansion valve that expands the refrigerant passing through the condenser;

a gas-liquid separator, through which the refrigerant passed through the at least one expansion valve flows, that separates and discharges the refrigerant into gas refrigerant and liquid refrigerant;

an evaporator that evaporates the liquid refrigerant discharged from the gas-liquid separator;

a refrigerant inflow pipe that connects the at least one expansion valve and the gas-liquid separator;

a bypass pipe that connects the gas-liquid separator and the compressor; and a refrigerant discharge pipe that connects the gas-liquid separator and the evaporator, wherein the gas-liquid separator comprises:

a housing in which a portion of each of the refrigerant inflow pipe, the bypass pipe, and the refrigerant discharge pipe is installed;

a first partition wall, which is installed in an internal accommodation space of the housing and having a first opening formed by cutting out a portion of an outer surface thereof and disposed adjacent to the refrigerant inflow pipe; and a second partition wall, which is spaced apart from the first partition wall and installed in the internal accommodation space of the housing and having a second opening formed by cutting out a portion of an outer surface thereof and disposed adjacent to the refrigerant discharge pipe, wherein a first end of the first opening is formed in a portion of a lower end of the first partition wall, which is farthest from a lower end of the second partition wall, and a first end of the second opening is formed in a portion, among the lower end of the second partition wall, which is farthest from the lower end of the first partition wall.

2. The air conditioner of claim 1, wherein the first partition wall and the second partition wall divide a first space, which is a space between the first partition wall and an inner surface of the housing, a second space, which is a space between the first partition wall and the second partition wall, and a third space, which is a space between the second partition wall and an inner surface of the housing, and wherein a distal end of the refrigerant inflow pipe is disposed in the first space, and a distal end of the refrigerant discharge pipe is disposed in the third space.

3. The air conditioner of claim 2, wherein the gas-liquid separator further comprises a base to which the lower end of the first partition wall and the lower end of the second partition wall are fixed, wherein the first opening extends in a direction crossing an upper surface of the base, and the first end of the first opening is connected to the lower end of the first partition wall, and wherein the second opening extends in a direction crossing the upper surface of the base, and the first end of the second opening is connected to the lower end of the second partition wall.

4. The air conditioner of claim 3, wherein the distal end of the refrigerant inflow pipe is disposed adjacent to the upper surface of the base and spaced apart from the first opening, and wherein the distal end of the refrigerant discharge pipe is disposed adjacent to the upper surface of the base and spaced apart from the second opening.

5. The air conditioner of claim 1, wherein a direction in which the first opening extends and a direction in which the second opening extends cross each other.

6. The air conditioner of claim 3, wherein the housing is formed in a cylindrical shape, and each of the first partition wall and second partition wall is bent at least once in a radial direction of the housing.

7. The air conditioner of claim 3, wherein each of the first partition wall and second partition wall is inclined at an acute angle with respect to the base.

8. The air conditioner of claim 2, wherein the gas-liquid separator comprises a cap spaced upward from the first partition wall and the second partition wall and coupled to an upper end of the housing, and wherein the portion of the bypass pipe is installed in the cap, and has a distal end disposed in a fourth space located above the second space and below the cap.

9. The air conditioner of claim 1, wherein the portion of the bypass pipe is connected in a vertical direction of the housing, and wherein each of the refrigerant inflow pipe and the portion of the refrigerant discharge pipe is connected to the housing in the vertical direction or in a horizontal direction.

10. An air conditioner, comprising:

a compressor that compresses a refrigerant;

a condenser that condenses the refrigerant discharged from the compressor;

at least one expansion valve that expands the refrigerant passing through the condenser;

a gas-liquid separator, through which the refrigerant passed through the at least one expansion valve flows, that separates and discharges the refrigerant into gas refrigerant and liquid refrigerant;

an evaporator that evaporates the liquid refrigerant discharged from the gas-liquid separator;

a refrigerant inflow pipe that connects the at least one expansion valve and the gas-liquid separator;

a bypass pipe that connects the gas-liquid separator and the compressor; and a refrigerant discharge pipe that connects the gas-liquid separator and the evaporator, wherein the gas-liquid separator comprises:

a housing in which a portion of each of the refrigerant inflow pipe, the bypass pipe, and the refrigerant discharge pipe is installed;

a first partition wall, which is installed in an internal accommodation space of the housing and having a first opening disposed adjacent to a distal end of the refrigerant inflow pipe; and a second partition wall, which is spaced apart from the first partition wall and installed in the internal accommodation space of the housing and having a second opening disposed adjacent to a distal end of the refrigerant discharge pipe, wherein the housing is formed in a cylindrical shape, and each of the first partition wall and second partition wall is bent at least once in a radial direction of the housing.

11. The air conditioner of claim 10, wherein the plurality of spaces include a first space, which is a space between the first partition wall and an inner surface of the housing, a second space, which is a space between the first partition wall and the second partition wall, and a third space, which is a space between the second partition wall and an inner surface of the housing, and wherein the distal end of the refrigerant inflow pipe is disposed in the first space, and the distal end of the refrigerant discharge pipe is disposed in the third space.

12. The air conditioner of claim 11, wherein the gas-liquid separator further comprises a base to which a lower end of the first partition wall and a lower end of the second partition wall are fixed, wherein the first opening extends in a direction crossing an upper surface of the base, and has a first end connected to the lower end of the first partition wall, and wherein the second opening extends in a direction crossing the upper surface of the base, and has a first end connected to the lower end of the second partition wall.

13. The air conditioner of claim 12, wherein the distal end of the refrigerant inflow pipe is disposed adjacent to the upper surface of the base and spaced apart from the first opening, and wherein the distal end of the refrigerant discharge pipe is disposed adjacent to the upper surface of the base and spaced apart from the second opening.

14. The air conditioner of claim 11, wherein the gas-liquid separator comprises a cap spaced upward from the first partition wall and the second partition wall and coupled to an upper end of the housing, and wherein the portion of the bypass pipe is installed in the cap, and has a distal end disposed in a fourth space located above the second space and below the cap.

15. An air conditioner, comprising:

a compressor that compresses a refrigerant;

a condenser that condenses the refrigerant discharged from the compressor;

at least one expansion valve that expands the refrigerant passing through the condenser;

a gas-liquid separator, through which the refrigerant passed through the at least one expansion valve flows, that separates and discharges the refrigerant into gas refrigerant and liquid refrigerant;

an evaporator that evaporates the liquid refrigerant discharged from the gas-liquid separator;

a refrigerant inflow pipe that connects the at least one expansion valve and the gas-liquid separator;

a bypass pipe that connects the gas-liquid separator and the compressor; and a refrigerant discharge pipe that connects the gas-liquid separator and the evaporator, wherein the gas-liquid separator comprises:

a housing in which a portion of each of the refrigerant inflow pipe, the bypass pipe, and the refrigerant discharge pipe is installed;

a first partition wall, which is installed in an internal accommodation space of the housing and having a first opening disposed adjacent to a distal end of the refrigerant inflow pipe;

a second partition wall, which is spaced apart from the first partition wall and installed in the internal accommodation space of the housing and having a second opening disposed adjacent to a distal end of the refrigerant discharge pipe; and a base to which a lower end of the first partition wall and a lower end of the second partition wall are fixed, wherein each of the first partition wall and second partition wall is inclined at an acute angle with respect to the base.

16. The air conditioner of claim 15, wherein the plurality of spaces include a first space, which is a space between the first partition wall and an inner surface of the housing, a second space, which is a space between the first partition wall and the second partition wall, and a third space, which is a space between the second partition wall and an inner surface of the housing, and wherein the distal end of the refrigerant inflow pipe is disposed in the first space, and the distal end of the refrigerant discharge pipe is disposed in the third space.

17. The air conditioner of claim 16, wherein the first opening extends in a direction crossing an upper surface of the base, and has a first end connected to the lower end of the first partition wall, and wherein the second opening extends in a direction crossing the upper surface of the base, and has a first end connected to the lower end of the second partition wall.

18. The air conditioner of claim 17, wherein the distal end of the refrigerant inflow pipe is disposed adjacent to the upper surface of the base and spaced apart from the first opening, and wherein the distal end of the refrigerant discharge pipe is disposed adjacent to the upper surface of the base and spaced apart from the second opening.

* * * * *